US006743025B2

(12) United States Patent
Howard

(10) Patent No.: US 6,743,025 B2
(45) Date of Patent: Jun. 1, 2004

(54) SELF-SEALING ELECTRICAL PLUG AND SOCKET ASSEMBLY FOR TRUCKS

(75) Inventor: Stephen M. Howard, The Colony, TX (US)

(73) Assignee: R.A. Phillips Industries, Inc., Santa Fe Springs, CA (US)

( * ) Notice: Subject to any disclaimer, the term of this patent is extended or adjusted under 35 U.S.C. 154(b) by 0 days.

(21) Appl. No.: 10/221,626

(22) PCT Filed: Mar. 22, 2001

(86) PCT No.: PCT/US01/09128

§ 371 (c)(1),
(2), (4) Date: Sep. 13, 2002

(87) PCT Pub. No.: WO01/71858

PCT Pub. Date: Sep. 27, 2001

(65) Prior Publication Data

US 2003/0054688 A1 Mar. 20, 2003

Related U.S. Application Data

(60) Provisional application No. 60/191,200, filed on Mar. 22, 2000.

(51) Int. Cl.[7] ..... H01R 33/00
(52) U.S. Cl. ..... 439/35; 439/445; 439/503
(58) Field of Search ..... 439/35, 34; 449/445, 449/503, 601

(56) References Cited

U.S. PATENT DOCUMENTS

| | | | | | |
|---|---|---|---|---|---|
| 4,846,697 | A | * | 7/1989 | Rodgers | 439/35 |
| 5,281,147 | A | * | 1/1994 | Hughes | 439/35 |
| 5,443,389 | A | * | 8/1995 | Hughes | 439/35 |
| 5,607,221 | A | * | 3/1997 | Justus | 362/485 |
| 6,048,224 | A | * | 4/2000 | Kay | 439/445 |
| 6,338,644 | B1 | * | 1/2002 | Fritzinger et al. | 439/445 |
| 6,450,833 | B1 | * | 9/2002 | Brown et al. | 439/518 |
| 6,554,626 | B2 | * | 4/2003 | Ramos, Jr. | 439/144 |

OTHER PUBLICATIONS

Standard J560 Report, Society of Automotive Engineers; 1951, 1998.
Phillips Industries catalog CAT100; pp. 12, 15 and 16 (published 2000).

* cited by examiner

*Primary Examiner*—Hung V. Ngo
(74) *Attorney, Agent, or Firm*—Christie, Parker & Hale, LLP

(57) ABSTRACT

An electrical plug (60) comprising a body (16) having an end (40) carrying a plurality of first ones of corresponding pairs of male (14) and female (17) electrical connection moieties. The plug includes a sleeve (20) axially extending from the body end outwardly from the moieties. The sleeve is defined by an outer periphery and an end (36) spaced apart from the body end. Integrally molded with the sleeve is a circumferential flange (22) extending radially from the outer periphery of the sleeve at the sleeve end.

8 Claims, 1 Drawing Sheet

SELF-SEALING ELECTRICAL PLUG AND SOCKET ASSEMBLY FOR TRUCKS

CROSS-REFERENCE TO RELATED APPLICATION

This application claims priority to the U.S. Provisional Application No. 60/191,200, filed Mar. 22, 2000.

FIELD OF THE INVENTION

The present invention relates to electric plug and socket assemblies and more particularly to substantially self-sealing electrical plug and socket assemblies for heavy-duty truck tractors.

BACKGROUND

Heavy duty trucks are composed of a tractor and one or more trailers coupled in series to the rear portion of the tractor. The trailers are equipped with various electrical devices which are powered from the tractor. To establish an electrical connection between the tractor and the trailer, an electrical cable is connected between the back of the tractor and the front of the trailer. Similar connections are also made between trailers if the truck rig includes a plurality of trailers.

The electrical cable has, at each end, suitable plugs configured to connect to cooperating sockets mounted, respectively, in the rear wall of the tractor cab and the front end of the trailer. The basic geometries of the electric cable plugs and the cooperating structures of the sockets are the subject of applicable SAE (Society of Automotive Engineers) standards, specifically SAE standard J560. Standardizing the geometries of the sockets and plugs ensures that any trailer can be electrically connected to any tractor using any cable assembly. SAE standard J560 is incorporated hereinto by reference.

Popular cable end plug and socket arrangements are described in catalog pages 12, 15 and 16 of the current catalog (CAT100) published by Phillips Industries, 12070 Burke Street, Santa Fe Springs, Calif. 90670, which is incorporated herein by reference. According to those arrangements, the socket is adapted to mate with the plug. The plug can be molded onto the end of a seven-conductor electrical cable; see for example, Phillips Part Nos. 16-7401 and 16-7402 (catalog page 16) in which such plugs are shown mated to sockets 16-726 and 16-826, respectively. The individual conductors in that cable connect within the molded plug body to female terminals which are disposed in an array corresponding to the array of male terminals which extend from the rear of socket. The female terminals are accessible at an end wall of a cavity bounded on its sides by a sleeve which is configured internally to mate intimately with the exterior of the barrel-like rear portion of the socket. The rear portion of the socket defines a linear key portion which cooperates in a keyway formed in the sleeve to assure that the plug and the socket have the correct angular relation to each other when they are mated together. The socket has an apertured spring blade cantilevered from the rear face of a socket mounting flange; the aperture in that spring blade receives a projection on the exterior of the plug sleeve when the plug and socket are mated, thereby holding the plug and the socket in that mated engagement. The projection with which the spring blade cooperates preferably is the exterior of the sleeve keyway.

The socket includes a flange which surrounds the socket barrel at its forward end and lies in a plane normal to the length of the barrel. A pair of mounting holes are formed through that flange adjacent respective sides of the socket barrel. Those mounting holes are used to mount the socket to the exterior surface of the rear wall of a truck tractor. The tractor rear wall has formed through it a corresponding pair of holes located on either side of a central larger hole which is sized to receive the barrel of the socket. A gasket, having holes through it in the same pattern as the holes in the tractor wall, also is used to mount the socket to the tractor; the gasket is interposed between the tractor wall and the socket flange, and a pair of nuts and bolts are used in the mounting holes to clamp the gasket socket to the tractor wall. The plug is then mated to the socket barrel on the other side of the tractor wall.

The socket body, including its mounting flange, is made of a hard material, such as die cast metal or glass filled molded nylon. The body of the plug, on the other hand, is molded of an elastomeric material. The walls of the sleeve portion of the plug are relatively thin, and so the sleeve can stretch slightly to conform snugly to the exterior of the socket barrel as the plug and socket are mated together. It has been found, however, that despite the use of a gasket as described above and despite the snug fit between of the plug sleeve with the exterior of the socket barrel, moisture can enter into the cavity between the mated barrel and sleeve over time during use of the connection formed by the socket and the plug. That moisture can produce corrosion of the mated electrical terminals of the connection, and so cause a fault in one or more of the circuits of which the connection terminals are components. It will be appreciated that, because socket and the plug are mated together at the forward (inside) surface of the tractor wall, it is difficult to obtain access to the plug and to make repairs to it.

Accordingly, there is a need for an improved socket and plug arrangement which makes their connection more secure against the entry of moisture into the cavity between the socket and the plug where their electrical terminals are located. This improvement would also assure that the socket and the plug are correctly mounted to the tractor wall in the first instance.

SUMMARY OF THE INVENTION

The present invention provides an electrical plug and socket assembly which seeks to avoid those and other deficiencies and problems found in currently available products. A presently preferred embodiment of the new assembly is described below with reference to the accompanying drawings. The drawings depict the cooperating structures for use in establishing an electrical connection between a tractor and trailer. However, as noted below, a assembly embodying features and principles of this invention can be configured differently for use in other contexts and utilities.

Generally speaking, a socket and plug assembly according to this invention includes an electrical plug comprising a body having an end carrying a plurality of first ones of corresponding pairs of male and female electrical connection moieties. The plug includes a sleeve axially extending from the body end outwardly from the moieties. The sleeve is defined by an outer periphery and an end spaced apart from the body end. Integrally molded with the sleeve is a circumferential flange extending radially from the outer periphery of the sleeve at the sleeve end.

In another aspect of the present invention, the socket and plug assembly comprises a socket comprising a barrel having a first end which is surrounded by a mounting flange and a second end having a plurality of first ones of corresponding pairs of male and female electrical connection moieties. The assembly also includes a plug having a body comprising a plurality of second ones of the corresponding pair of moieties for mating with the plurality of first ones and a plug sleeve axially extending from the body outwardly from the second ones of the connection moieties. The sleeve carries a peripheral flange which has substantially the same outer perimeter shape as that of the socket mounting flange to mate in sealing contact with the mounting flange.

DESCRIPTION OF THE DRAWINGS

These and other features and advantages of the present invention will be better understood by reference to the following detailed description when considered in conjunction with the accompanying drawing, wherein.

DETAILED DESCRIPTION

Figure 1:
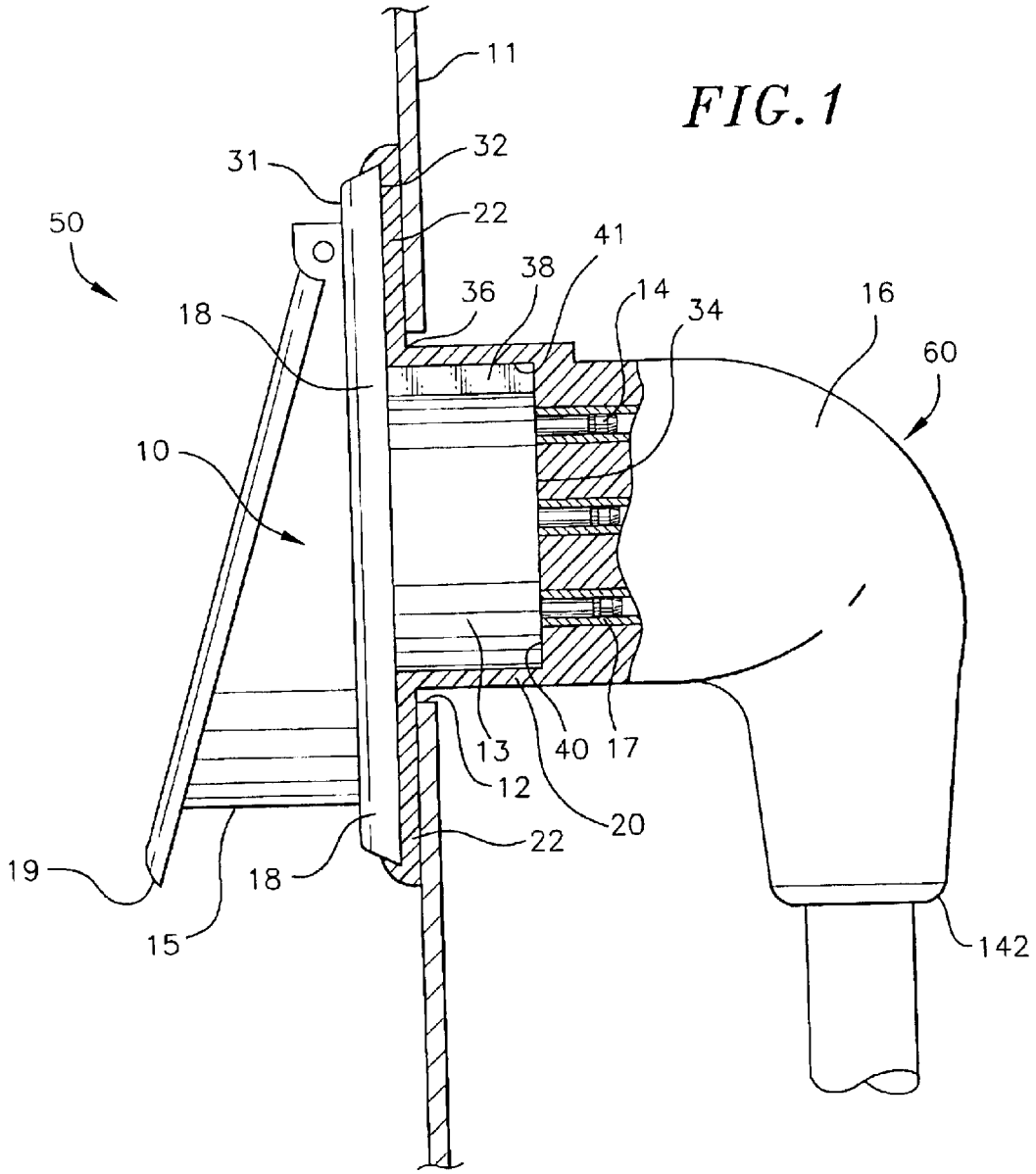
FIG. 1 is a fragmentary cross-sectional elevational view of the improved socket and plug connection provided by this invention.

FIG. 1 shows the an electrical plug and socket assembly 50 of the present invention installed on a rear tractor wall 11. As shown, the plug is connected with the socket by way of a socket barrel receiving hole 12 provided in the tractor wall. When connected, the socket rear male terminals 14 are mated with plug female terminals 17.

In a preferred embodiment, the socket 10 includes a generally circumferential mounting flange 18 having a rear face 31 and a front face 32, respectively. The socket terminals 14 extend from a front end of a socket barrel 13 which projects beyond flange front face 32. Such a socket is similar to Phillips Part No. 16-724 described in CAT100. The mounting flange 18 is generally heptagonal and made of a hardened material, such as die cast metal or glass filled molded nylon.

A socket sleeve 15 is generally annular and integrally formed from the same material as the mounting flange. The socket barrel 13 carries seven male pins (not shown) in an array per SAE standard J650. The seven pins extend into the inside of the socket sleeve 15 and form a socket into which can be plugged an end of the electrical cable connecting the tractor to a trailer. The socket is closeable by a spring loaded cap 19 hinged from the rear face 31 of the socket mounting flange 18.

The socket barrel 13 is generally circular and carries seven male terminals 14. Terminals 14 can be the opposite end of the pins accessible in socket sleeve 15, and so terminals 14 can be arranged in an array like that of the terminal array according to SAE standard J650. The barrel 13 is adapted to mate with a sleeve of a corresponding electrical plug 60.

The electrical plug 60 comprises a generally round body 16 optionally formed in the shape of an L-shaped elbow having a first end 40 and a second end 42. The first end 40 carries seven female terminals 17 that extend into the body 16 in an array which matches the array of the socket terminals 14. The body 16 is made of an elastomeric material and includes an annular sleeve 20 which axially extends from the first end 40 of the plug outwardly from the female terminals 17 to form a annular cavity 34. The cavity 34 is of suitable diameter to receive the socket barrel 13 with a snug fit. The second end 42 of the electrical plug is coupled to a multi-conductor electrical cable.

Male terminals 14 and female terminals 17 are respective moieties of axial engage/disengage electrical connector arrangements. In the practice of this invention, the position of those moieties can be reversed if desired. So long as those moieties provide axial engage/disengage cooperation, they can be of any form or design which may be desired.

As shown in FIG. 1, a forward end 36 of plug sleeve 20 carries a peripheral integral flange 22 radially extending circumferentially from the outer perimeter of the sleeve20. The flange 22 preferably has the same outer perimeter shape as that of the perimeter of socket flange 18. A forward face of the plug flange 22 may be adapted to have a contour which is a mirror image of the contour of the rear face 32 of the socket flange 18. It will be recalled that the body of plug 16 is molded of an elastomeric material. The walls of the plug sleeve 20 and flange 22 are relatively thin such that those portions of the plug are readily deformable by hand. That deformability of the plug sleeve and flange makes it easy for them to be deformed and forced through the hole 12 in the tractor wall from the rear (interior) side, if desired, of the tractor wall so that the plug flange forward surface can abut the rear surface of the tractor wall circumferentially about hole 12. Accordingly, the sleeve 20, as so disposed in hole 12, can return to its as-molded shape.

The connection of the socket to the plug is completed by inserting the socket barrel 13 into the cavity 34 in the plug sleeve to cause mating of the socket and plug terminals and mating of the forward face of the socket flange 18 with the rear face of plug flange 122. The connection is mechanically secured together by bolts and nuts, the bolts passing through corresponding holes formed in the socket flange, the tractor wall, and the plug flange. In that way the plug flange is securely clamped between the tractor wall and the socket flange to hermetically seal the space between the socket barrel and the plug sleeve and body.

An orienting key projection 38 can be defined in the exterior of the socket barrel 13 for cooperation with a mating keyway 42 in the inner surface of the plug sleeve 20.

It also is within the scope of this invention that the plug flange 22 can be made larger in size and area than the socket flange 18. In that instance, the outer margins of the plug sleeve can be formed to fit over the edges of the socket sleeve, as shown in the accompanying drawings.

The preceding description of the use of this invention has been in the context of the mounting of a socket to the rear wall of a truck tractor. Persons knowledgeable about the heavy duty truck industry will readily understand and appreciate that similar improvements in socket mountings can be applied to the mounting of electrical sockets to the rear ends of trailers adapted to be used in tandem truck rigs. The advances and improvements provided for mounting of electrical sockets in trucks can also be used in the mounting of sockets to the front ends of trailers even if the trailer front end socket connections include circuit breaker arrays associated with the sockets. Such circuit breaker arrays are mounted on a carrier which also mounts the socket electrical terminals to which SAE standard J560 is pertinent. That carrier can have mounted to it, as by bonding, an elastomeric molding which has features analogous to plug sleeve 20 and plug flange 22 and which also seals against the rear end of the socket body about the array of terminals mounted to the carrier. Persons knowledgeable about the heavy duty truck industry also will appreciate and grasp the ready adaptability of this invention to the mounting of electrical connection sockets to dollies which are used to support and to secure trailers in tandem truck rigs. Those dollies have their own brake and brake light systems.

The foregoing references to existing products of Phillips Industries have been used only for the sake of convenience and brevity of explanation of this invention; such references are not to be interpreted or construed as limitations or restrictions upon the scope of this invention.

It is believed that the best utility of this invention is in the context of original manufacture of truck tractors, trailers and dollies, as opposed to the modification or repair of existing tractors, trailers and dollies where the invention also has utility.

While the invention is disclosed in conjunction with specific embodiments thereof, it is to be evident that many alternatives, modifications, and variations will be apparent to those skilled in the art in light of the foregoing description. Accordingly, it is intended to embrace all such alternatives, modifications and variations as falling within the spirit and broad scope of the appended claims.

What is claimed is:

1. An electrical connector cooperable with a socket assembly mountable to an exterior surface of a wall of a first wheeled vehicle, selected from the group which includes truck tractors and truck trailers, the socket assembly having a barrel extendible through an opening in the wall into the interior of the first vehicle and in which is carried at least one male electrical terminal which extends at a first end thereof into a cavity at a first barrel end to define a socket cooperable with a cable plug by which the first vehicle can be electrically coupled to a second wheeled vehicle selected from that group, each male terminal at an opposite second end having associated with it at a second barrel end opposite the cavity a first moiety of a pair of male and female electrical connection moieties, the socket assembly also having a flange disposable around the opening on the exterior side of the wall, the connector comprising a body defining a sleeve having an open end and a closed end and matable around the socket assembly barrel second end, the body carrying at the closed end of the sleeve a second moiety of the pair of connection moieties for which there is a first moiety of the pair carried by the socket assembly barrel, the body at the sleeve open end defining a connector flange extending outwardly from the sleeve around the sleeve, the sleeve end the connector flange being deformable adequately to permit the connector flange to be passed through the aforesaid wall opening which is sized to receive and cooperate substantially closely with the sleeve.

2. The connector of claim 1 in which the sleeve and the connector flange are molded integrally with the connector body.

3. The connector of claim 2 in which the connector body and the sleeve and connector flange are composed of an elastomeric material.

4. The connector according to claim 1 in which the face of the connector flange has a perimeter configuration similar to the perimeter configuration of the socket assembly flange.

5. The connector according to claim 1 in which the socket assembly flange and the connector flange are matable in face-to-face relation, and the mating face of the connector flange is contoured substantially as a mirror image of the contour of the muting face of the socket assembly flange.

6. The connector according to any one of claims 1 through 5 inclusive in which the socket assembly terminals are disposed in an array conforming to SAE Standard J560.

7. An electrical connector cooperable with an electrical article mountable to an exterior surface of a wall, the article having a part thereof extendible through an opening in the wail to an end in which there are exposed first moieties of a plurality of pairs of male and female electrical connection moieties, the article also has a surface disposable around the opening on the exterior side of the wall, the connector comprising a body defining a sleeve having an open end and a closed end and matable around said article part, the body carrying at the closed end of the sleeve the second moieties of the plural pairs of connection moieties, the body at the sleeve open end defining a connector flange extending outwardly from the sleeve around the sleeve, the sleeve and the connector flange being deformable adequately to permit the connector flange to be passed through a wall opening sized to receive and cooperate substantially closely with the sleeve.

8. The connector according to claim 7 in which the article is an electrical socket assembly conforming to SAE Standard J560.

* * * * *